United States Patent [19]

Sharma

[11] Patent Number: 4,525,212

[45] Date of Patent: Jun. 25, 1985

[54] DECONTAMINATION OF ALUMINUM BY CHLORINATION

[75] Inventor: Ram A. Sharma, Troy, Mich.

[73] Assignee: General Motors Corporation, Detroit, Mich.

[21] Appl. No.: 564,569

[22] Filed: Dec. 22, 1983

[51] Int. Cl.[3] ..... C22B 21/06; C22B 9/05

[52] U.S. Cl. ..... 75/68 R; 75/93 AC; 423/210.5; 423/241; 423/DIG. 9; 423/DIG. 12

[58] Field of Search ..... 75/68 R, 68 B, 93 AC, 75/257; 156/DIG. 66, DIG. 78, DIG. 104; 423/210.5, 240, 241, 495, 497, DIG. 9, DIG. 12

[56] References Cited

U.S. PATENT DOCUMENTS 3,650,730 3/1972 Derham et al. ..... 75/93 AC
3,845,191 10/1974 Bruce et al. ..... 423/497
3,854,934 12/1974 Dore et al. ..... 75/68 R
4,447,262 5/1984 Gay et al. ..... 423/DIG. 12

OTHER PUBLICATIONS

Donald A. Wenz et al., "$CaCl_2$—Rich Region of the $CaCl_2$—$CaF_2$—CaO System", Journal of Chemical and Engineering Data, vol. 14, No. 2, p. 250, Apr. 1969.

*Primary Examiner*—Edward J. Meros
*Assistant Examiner*—Robert Alway
*Attorney, Agent, or Firm*—Lawrence B. Plant

[57] ABSTRACT

Decontaminating an aluminum melt by chlorination wherein the melt is blanketed with a layer of molten flux containing calcium oxide to consume any $Cl_2$ and/or $AlCl_3$ offgasses from the melt.

2 Claims, 2 Drawing Figures

DECONTAMINATION OF ALUMINUM BY CHLORINATION

This invention relates to a process for decontaminating an aluminum melt by chlorination and more particularly to chemically trapping any evolved chlorine/chloride emanating therefrom.

BACKGROUND OF THE INVENTION

It is well known to those skilled in the art that aluminum (primary or secondary) can be decontaminated by treating melts thereof with chlorine. In this regard, chlorine gas is bubbled up through the melt to strip the melt of such contaminants as hydrogen, magnesium, sodium, calcium, fine oxides, etc. The chlorine may be introduced as 100% chlorine gas; diluted (e.g. with inert gas) chlorine gas; or may be released from a variety of gaseous or solid materials such as Freon 12, hexachloroethane, chloronated hydrocarbons, etc. which decompose in the melt. Such chlorination treatments are performed at temperatures typically ranging from about 675° C. to about 900° C. and in some instances are conducted under a layer of molten flux floating atop the melt to protect the melt from ambient air oxidation. During the course of the treatment, hydrogen and the fine oxides are removed primarily by mechanical action while the magnesium, sodium, and calcium, are removed by chemical reaction with the chlorine to form magnesium chloride, sodium chloride and calcium chloride which floats to the top of the melt and are skimmed off. Unfortunately, unreacted chlorine and gaseous aluminum chloride are evolved from the melt. Upon contact with moisture in the air, the aluminum chloride forms HCl and fine aluminum oxide powder. This hydrogen chloride, fine aluminum oxide and excess chlorine pollutes the surrounding atmosphere and necessitates the costly purchase, operation and maintenance of air treatment equipment to remove the pollutants.

It is the primary object of the present invention to substantially eliminate chlorine/chloride offgassing from aluminum melts undergoing chlorination by blanketing the melt with a molten layer of flux which not only protects the melt from ambient air oxidation but also consumes the chlorine/chloride offgases from the melt before they pollute the surrounding environment. This and other objects and advantages of the present invention will become more readily apparent from the description thereof which follows.

BRIEF DESCRIPTION OF THE INVENTION

This invention comprehends floating a molten layer of flux atop the surface of an aluminum melt undergoing chlorination which flux comprises a solution of calcium chloride and calcium oxide. The calcium oxide content of the solution reacts with and consumes any gaseous chlorine or aluminum trichloride effluent exiting the melt and thereby prevent pollution of the surrounding environment by the effluent. In a preferred embodiment, the molten flux is a two-phase slush comprising a finely divided solid calcium oxide phase suspended in a liquid $CaCl_2$—CaO phase. In this embodiment, the sodium calcium oxide phase slowly dissolves into the liquid phase to regenerate the dissolved calcium oxide consumed by the chlorine and/or aluminum chloride effluent. Additional salts, such as calcium fluoride, may also be used to lower the melting temperature of the flux.

DETAILED DESCRIPTION OF THE INVENTION

The invention may better be understood when considered in relation to the following detailed description thereof which is given in conjunction with the several Figures in which.

Figure 1:
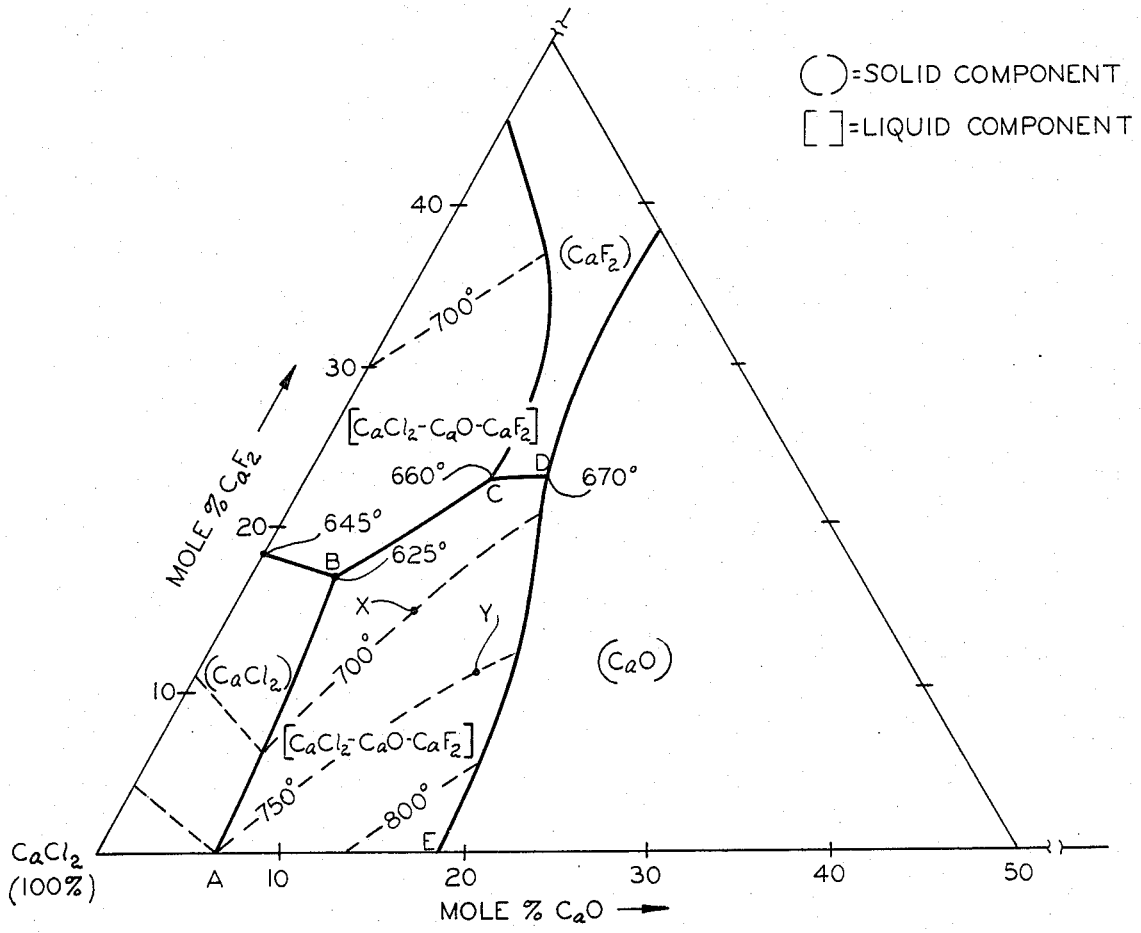
FIG. 1 is a phase diagram for the ternary $CaCl_2$—CaO—$CaF_2$ system.
Figure 2:
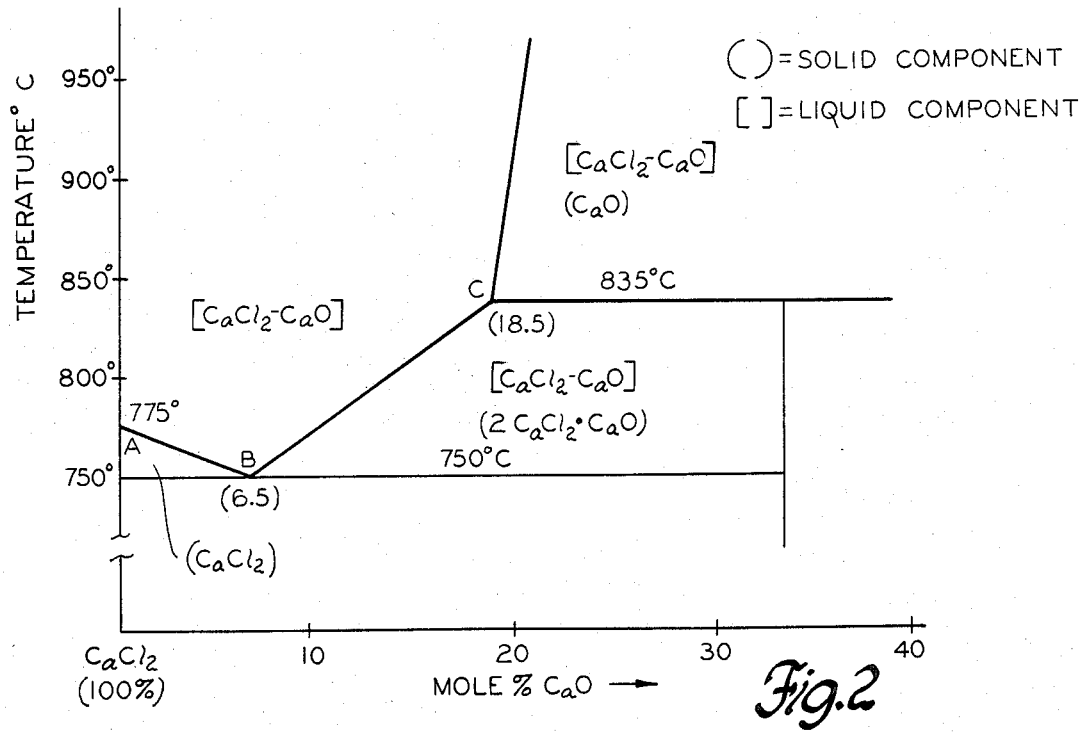
FIG. 2 is a phase diagram for the binary $CaCl_2$—CaO system.

FIGS. 1 and 2 show the liquidus curves for the ternary $CaCl_2$—CaO—$CaF_2$ and the binary $CaCl_2$—CaO systems respectively and show the wide range of chlorination temperatures and liquid phase CaO concentrations available for use in the process of the present invention. The composition of the molten flux and the chlorination temperature will preferably lie in the region bounded by the curves AB, BC, CD, DE and EA of FIG. 1 and above the curve A B C of FIG. 2. For example, (see point X on FIG. 1), chlorination could be conducted at 700° C. and using a molten flux having a liquid solution phase comprising about 10 mole percent CaO, about 75 mole percent $CaCl_2$ and about 15 mole percent $CaF_2$. On the other hand, if about 15 mole percent CaO were desirable (see point Y) the chlorination temperature could be raised to about 750° C. and the $CaCl_2$ content would drop to about 74 mole percent and the $CaF_2$ content drop to about 11 mole percent.

As shown in FIG. 2, the binary $CaCl_2$—CaO system requires that the chlorination temperature be at least 750° C. in order to have a liquid $CaCl_2$—CaO phase present. If chlorination were to be conducted at 750° C., the liquid phase would comprise about 6.5 mole percent CaO whereas at higher temperatures more CaO could be present in the solution (i.e., up to about 18.5 mole percent at about 835° C.) for more effective gettering of the $Cl_2/AlCl_3$ effluent.

In a preferred embodiment of the invention, $Cl_2/AlCl_3$ trap will comprise a slush containing small particles of solid CaO floating throughout the liquid $CaCl_2$—CaO phase to regenerate, by dissolution, such of the dissolved CaO as is consumed by the $Cl_2$ and $AlCl_3$ effluent. The amount of solid CaO is strictly a matter of choice and will depend primarily on the efficiency of the chlorination process and hence the amount of chlorine/chloride effluent exiting the melt. About ten percent (10%) by volume solid CaO is seen to provide adequate CaO reserve without unduly thickening the flux.

While this invention has been disclosed in terms of specific embodiments thereof it is not intended to be limited thereto but only to the extent set forth hereafter in the claims which follows.

The embodiments of an invention in which an exclusive property or privilege is claimed are defined as follows:

1. In the process of decontaminating aluminum melt by floating a layer of molten flux atop the surface of the melt and bubbling gaseous chlorine through the melt, the improvement wherein said layer comprises a solution of calcium chloride and calcium oxide wherein said calcium oxide is sufficient to consume as calcium chloride any chlorine and aluminum chloride evolving from the surface.

2. In the process of decontaminating aluminum by covering a melt thereof with a layer of flux and chlorinating the melt with the consequent evolution of chlorine and aluminum chloride therefrom, the improvement wherein said layer comprises a slush having solid and liquid phases in which said solid phase comprises calcium oxide and said liquid phase comprises a molten solution of calcium chloride and calcium oxide, said liquid phase serving to consume said chlorine and aluminum chloride as calcium chloride to prevent their escape into the surrounding atmosphere and said solid phase serving by dissolution to replenish the calcium oxide so consumed from said liquid phase.

* * * * *

UNITED STATES PATENT AND TRADEMARK OFFICE

CERTIFICATE OF CORRECTION

PATENT NO. : 4,525,212

DATED : June 25, 1985

INVENTOR(S) : Ram A. Sharma

It is certified that error appears in the above—identified patent and that said Letters Patent is hereby corrected as shown below:

Column 1, lines 62 & 63, "sodium" should read -- solid --.

Signed and Sealed this

*Twenty-second* Day of *October 1985*

[SEAL]

*Attest:*

DONALD J. QUIGG

*Attesting Officer*

*Commissioner of Patents and Trademarks—Designate*